US010519629B2

(12) United States Patent
Endo

(10) Patent No.: US 10,519,629 B2
(45) Date of Patent: Dec. 31, 2019

(54) WORKING MACHINE

(71) Applicant: KOBELCO CONSTRUCTION MACHINERY CO., LTD., Hiroshima-shi (JP)

(72) Inventor: Kazuomi Endo, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 16/143,648

(22) Filed: Sep. 27, 2018

(65) Prior Publication Data

US 2019/0127956 A1 May 2, 2019

(30) Foreign Application Priority Data

Oct. 27, 2017 (JP) ..... 2017-207894

(51) Int. Cl.
*E02F 9/26* (2006.01)
*E02F 3/43* (2006.01)
(Continued)

(52) U.S. Cl.
CPC ..... *E02F 9/2235* (2013.01); *E02F 9/264* (2013.01); *E02F 3/43* (2013.01); *E02F 9/2029* (2013.01); *E02F 9/2037* (2013.01); *E02F 9/2282* (2013.01)

(58) Field of Classification Search
CPC . E02F 3/43; E02F 3/963; E02F 9/0858; E02F 9/2025; E02F 9/2029; E02F 9/2037;
(Continued)

(56) References Cited

U.S. PATENT DOCUMENTS 6,061,617 A * 5/2000 Berger ..... A01B 63/10 700/18
6,119,054 A 9/2000 Miki et al.
(Continued)

FOREIGN PATENT DOCUMENTS

JP 10-237904 9/1998
JP 11-140911 5/1999
(Continued)

OTHER PUBLICATIONS

Extended European Search Report dated Jun. 7, 2019 in European Patent Application No. 18197905.5, 6 pages.

*Primary Examiner* — Tyler J Lee
(74) *Attorney, Agent, or Firm* — Oblon, McClelland, Maier & Neustadt, L.L.P.

(57) ABSTRACT

A determination portion determines whether a working device is at a receivable posture which allows a receiving device to receive a radio signal transmitted from a transmission device 5 or the working device is at an unreceivable posture which does not allow the receiving device to receive the radio signal transmitted from the transmission device based on posture information detected by a posture sensor. Then, when determining that the working device 4 is at the unreceivable posture, the determination portion sets the receiving device in a power saving mode. On the other hand, when determining that the working device takes the receivable posture with the receiving device being set in the power saving mode, the determination portion returns the receiving device 6 to a normal power mode.

5 Claims, 5 Drawing Sheets

(51) Int. Cl.
*E02F 9/22* (2006.01)
*E02F 9/20* (2006.01)

(58) Field of Classification Search
CPC ..... E02F 9/2235; E02F 9/2282; E02F 9/264; E02F 9/265; G07C 5/085
See application file for complete search history.

(56) References Cited

U.S. PATENT DOCUMENTS

| | | | | |
|---|---|---|---|---|
| 6,542,789 | B2 * | 4/2003 | Ufheil | G05B 19/04 700/275 |
| 6,928,353 | B2 * | 8/2005 | Finley | G05B 19/042 455/419 |
| 7,099,722 | B2 * | 8/2006 | Casey | E02F 3/96 700/188 |
| 9,051,718 | B2 * | 6/2015 | Schmidt | E02F 3/325 |
| 9,260,838 | B2 * | 2/2016 | Sawada | E02F 9/2235 |
| 10,289,097 | B2 * | 5/2019 | Butler | G05B 19/4155 |
| 2011/0016756 | A1 * | 1/2011 | Schmidt | E02F 3/325 37/403 |
| 2011/0313625 | A1 | 12/2011 | Miller et al. | |

FOREIGN PATENT DOCUMENTS

| | | |
|---|---|---|
| JP | 2001-323516 | 11/2001 |
| JP | 2010-273344 | 12/2010 |
| KR | 10-2010-0074557 A | 7/2010 |
| WO | WO 2010/061165 A1 | 6/2010 |

* cited by examiner

WORKING MACHINE

FIELD OF THE INVENTION

The present invention relates to a working machine which transmits a radio signal including identification information from a transmission device provided in an attachment to a receiving device provided on a main body portion side.

BACKGROUND ART

In recent years, it is demanded to identify an attachment mounted on a construction machine in real time in order to appropriately control the construction machine, appropriately manage operating conditions of the construction machine, or the like. For example, JP2010-273344A discloses a technique of allowing an operator to input identification information of an attachment at the time of mounting the attachment and managing the attachment mounted on a working device based on the input identification information.

JP2010-273344A, however, has a problem that every time the attachment is replaced, an operator is required to input identification information, resulting in increasing operator' burden. Additionally, an operator may forget inputting identification information, and in this case, there occurs a problem that a working machine cannot identify the attachment.

Under these circumstances, there is proposed a technique of transmitting proper information of an attachment from a transmitter disposed in the attachment to a receiver disposed on a main body portion side.

For setting control parameters with a single action, such as a hydraulic pressure to be supplied and a flow rate which are required of a replaceable attachment, for example, JPH10-237904A discloses a technique of providing the attachment with a transmitter, causing a ROM of the transmitter to store proper information of the attachment, such as an accelerator position and a pump setting output, and transmitting the proper information from the transmitter to a controller on an apparatus main body side via wires or wirelessly, thereby causing the controller to control a construction machine according to the proper information.

JPH10-237904A, however, does not take into consideration the suppression of power consumption of the receiver which receives a radio signal and therefore needs improvement in this respect.

SUMMARY OF THE INVENTION

For saving power consumed by a receiving device, the inventor of the present invention has conceived the present invention in view of the fact that a receiving device provided on a main body portion side is in a state of incapable of receiving a radio signal transmitted from a transmission device in some cases, and also the fact that such a state can be grasped according to a posture of a working device.

A working machine according to an aspect of the present invention includes a main body portion; a working device mounted on the main body portion so as to have a changeable posture and including one or a plurality of replaceable replacement portions; a posture sensor which detects a posture of the working device; one or a plurality of transmission devices disposed in the replacement portions for transmitting a radio signal including identification information of the replacement portions; a receiving device disposed in the main body portion for receiving a radio signal transmitted from the transmission devices; and a determination portion which determines whether the working device is at a receivable posture which allows the receiving device to receive the radio signal or the working device is at an unreceivable posture which does not allow the receiving device to receive the radio signal based on posture information detected by the posture sensor; in which when determining that the working device is at the unreceivable posture, the determination portion sets the receiving device in a power saving mode in which the radio signal is unreceivable, and when determining that the working device takes the receivable posture with the receiving device being set in the power saving mode, and returns the receiving device to a normal power mode in which the radio signal is receivable.

DESCRIPTION OF EMBODIMENTS

First Embodiment

Figure 1:
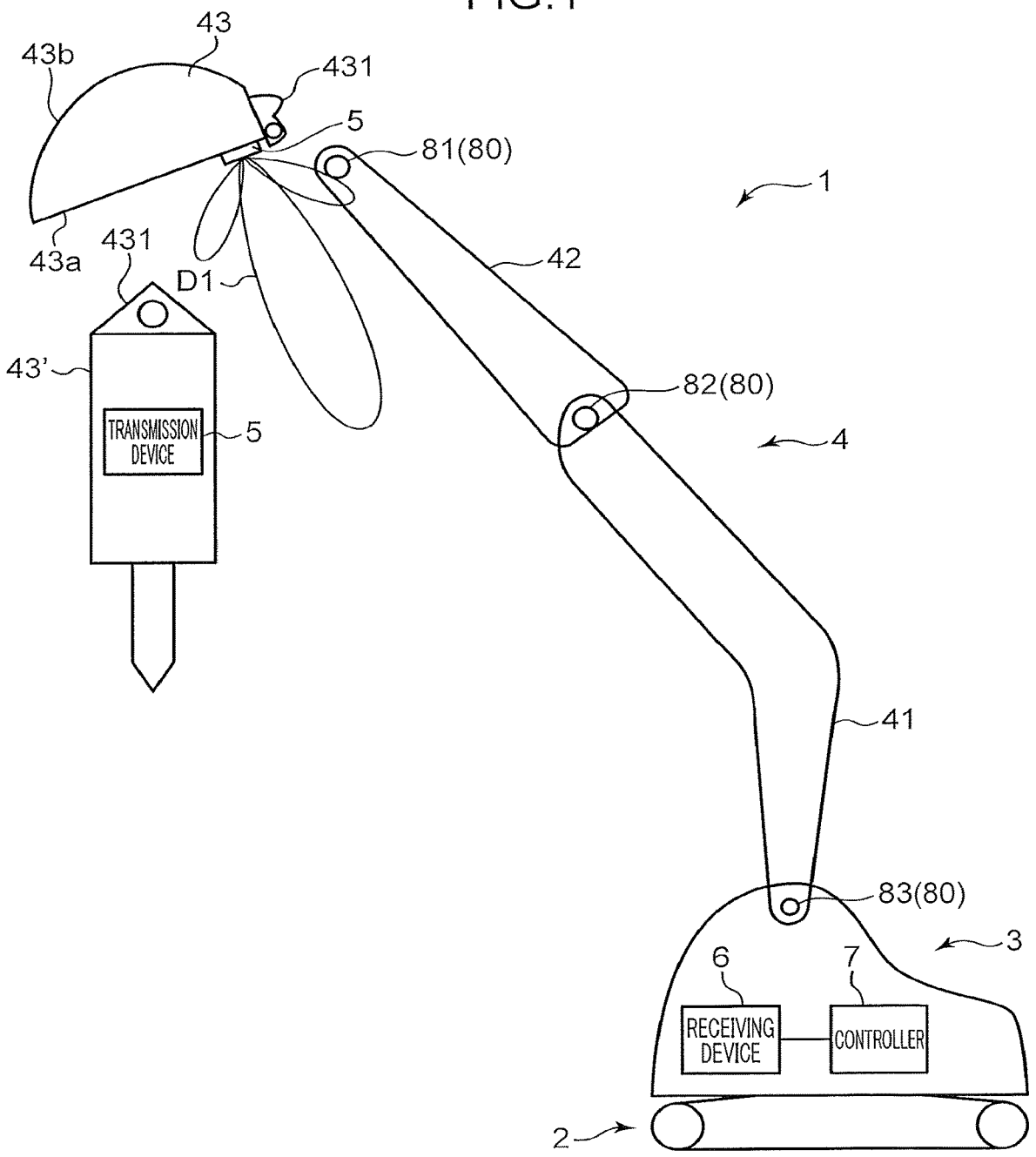
FIG. 1 is a configuration view of a working machine according to a first embodiment of the present invention.

FIG. 1 is a configuration view of a working machine 1 according to a first embodiment of the present invention. Although the working machine 1 is configured with a hydraulic excavator in the example in FIG. 1, this is merely an example and the working machine 1 may be configured with a construction machine other than a hydraulic crane or the like.

The working machine 1 includes a lower travelling body 2 of a crawler type, an upper slewing body 3 provided turnably on the lower travelling body 2, and a working device 4 mounted on the upper slewing body 3. The lower travelling body 2 and the upper slewing body 3 configure a main body portion of the working machine 1.

The working device 4 includes a boom 41 mounted on the upper slewing body 3 so as to go up and down, an arm 42 swingably mounted on a front end of the boom 41, and an attachment 43 swingably mounted on a front end of the arm 42. The working device 4 also includes an actuator (not shown) which causes the boom 41 to go up and down with respect to the upper slewing body 3, an actuator (not shown) which causes the arm 42 to swing with respect to the boom 41, and an actuator (not shown) which causes the attachment 43 to swing with respect to the arm 42.

The working device 4 changes an angle between the boom 41 and the upper slewing body 3, an angle between the boom 41 and the arm 42, and an angle between the arm 42 and the attachment 43, thereby changing a posture according to operation by an operator.

The attachment 43 includes an attaching device 431. The attaching device 431 is a device for replaceably attaching the attachment 43 to the front end of the arm 42. Although in the example shown in FIG. 1, the attachment 43 is configured with a bucket, for example, this is merely an example and the attachment 43 may be any attachment that is replaceable with a hydraulic excavator, such as a breaker or a nibbler. An attachment 43' is configured with a breaker, for example. The attachment 43' also includes the attaching device 431 and is replaceably attached to the front end of the arm 42. Thus, the attachment 43 formed of a bucket and the attachment 43' formed of a breaker can be alternatively exchanged from each other in the working machine 1. In the first embodiment, the attachments 43 and 43' correspond to one example of a replaceable replacement portion in the working device 4.

A transmission device 5 is disposed in the attachment 43. The transmission device 5 transmits a radio signal including identification information of the attachment 43. Similarly to the attachment 43, the attachment 43' also transmits a radio signal including identification information of the attachment 43'.

Although in the example of FIG. 1, the transmission device 5 is provided on a rear end side (a side of the arm 42) of a face 43*a* opposed to the ground when the attachment 43 moves toward the ground at the time of drilling work, this is merely an example. The transmission device 5, which is not particularly limited to a specific arrangement position, may be provided on a front end side of the face 43*a* or may be provided at an appropriate position on a lower surface 43*b*.

A communicable area D1 defines a range in which a radio signal transmitted from the transmission device 5 arrives. The communicable area D1 is determined by directional characteristics of an antenna 501 and an output transmitted from the transmission device 5. Here, the communicable area D1 is composed of a main lobe extending in a normal line direction on a radiation plane of the transmission device 5, and a plurality of side lobes extending in a direction diagonal to the normal line direction with the main lobe provided therebetween. The antenna 501 may be an antenna having directional characteristics of non-direction.

A posture sensor 83 for detecting a rotation angle of the boom 41 is provided at a joint between the upper slewing body 3 and the boom 41, a posture sensor 82 for detecting a rotation angle of the arm 42 is provided at a joint between the boom 41 and the arm 42, and a posture sensor 81 for detecting a rotation angle of the attachment 43 is provided at a joint between the arm 42 and the attachment 43. In the following, when generically referred to, the posture sensors 81 to 83 will be referred to as a posture sensor 80.

A receiving device 6 which receives a radio signal transmitted from the transmission device 5 and a controller 7 in charge of entire control of the working machine 1 are provided inside the upper slewing body 3.

Further provided inside the upper slewing body 3 are an engine as a power source, a hydraulic pump driven by the engine, and a control valve which adjusts a supply amount of a hydraulic oil to be discharged from the hydraulic pump to the actuator. The controller 7 controls the control valve according to an amount of operation of the operation lever for operating the working device 4, thereby adjusting a discharge amount of a hydraulic oil to be supplied to the actuator from the hydraulic pump. As a result, the working device 4 takes a posture corresponding to the amount of operation input to the operation lever by the operator.

Figure 2:
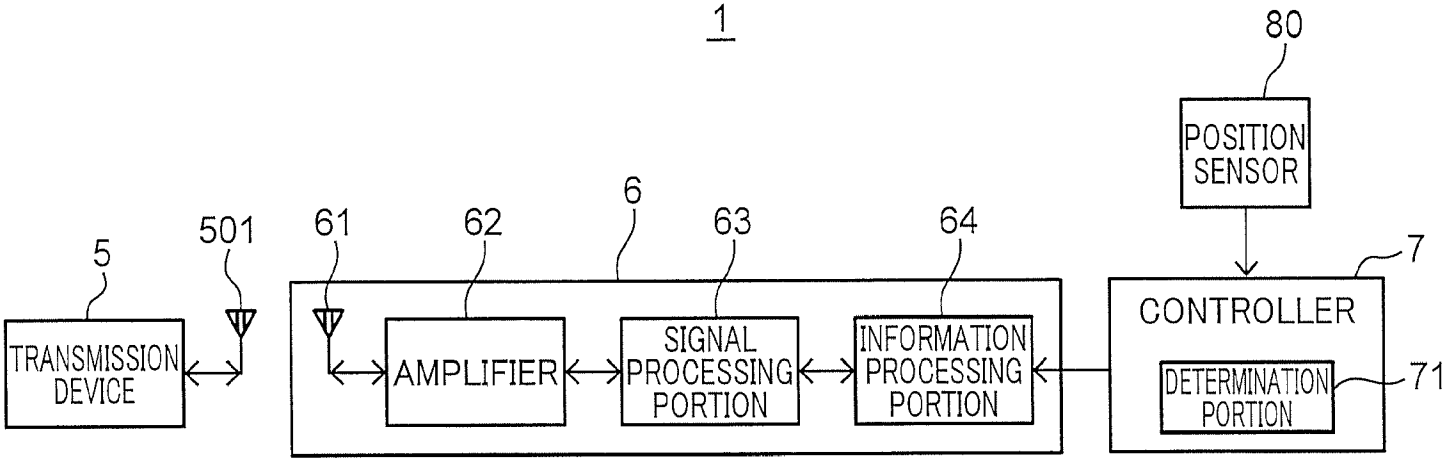
FIG. 2 is a block diagram of components in charge of communication in the working machine shown in FIG. 1.

FIG. 2 is a block diagram of components in charge of communication in the working machine 1 shown in FIG. 1. The transmission device 5 is configured with an IC tag, for example. The transmission device 5 includes the antenna 501 for outputting a radio signal including identification information of the attachment 43 to an external space. In addition, the transmission device 5 includes a memory which stores identification information, and an electronic circuit which reads the identification information from the memory, and modifies transmission data including the read identification information to generate a radio signal and output the radio signal from the antenna 501.

The IC tag is also referred to as a radio frequency identifier (RFID) tag and can be an active type IC tag using a contained battery as a power source, or a passive type IC tag using radio waves from an IC tag reader as a power source. Some of the active type IC tags convert environmental energy such as vibration or sunlight into electricity for use as a power source. Since the working device 4 is configured with a construction machine such as a hydraulic excavator, vibration occurs and the working device 4 is commonly used under sunlight.

The present embodiment therefore adopts, as the transmission device 5, an active type IC tag which uses electricity obtained from environmental energy as a power source. However, the present invention is not limited thereto and may adopt a passive type IC tag or an active type IC tag equipped with an ordinary battery. Additionally, the transmission device 5 in the present embodiment may transmit a radio signal including identification information at a fixed sampling interval, or may transmit a radio signal including identification information according to a request from the receiving device 6.

As the identification information, information indicative of classification of the attachment 43, information indicative of a manufacturer, and information including at least one of a serial number and a product number can be adopted. The information indicative of classification is, for example, information indicative of a bucket when the attachment 43 is a bucket and is information indicative of a breaker when the attachment 43 is a breaker.

The receiving device 6 is configured with, an IC tag reader, for example. In detail, the receiving device 6 includes an antenna 61, an amplifier 62, a signal processing portion 63, and an information processing portion 64. The antenna 61 receives a radio signal transmitted from the transmission device 5. The amplifier 62 amplifies the received radio signal. The signal processing portion 63 demodulates the amplified radio signal to extract transmission data. The information processing portion 64 decodes the extracted transmission data to acquire identification information and output the identification information to the controller 7.

Additionally, the receiving device 6 is configured to be switchable between a power saving mode in which the receiving device 6 is driven with power consumption by which a radio signal is unreceivable and a normal power mode in which the receiving device 6 is driven with power consumption by which a radio signal is receivable. In the normal power mode, power is supplied to all the circuit elements configuring the amplifier 62, the signal processing portion 63, and the information processing portion 64 from a power supply circuit (not shown), so that each of the amplifier 62, the signal processing portion 63, and the information processing portion 64 is driven in a normal power state. On the other hand, in the power saving mode, power is supplied only to a specific part of the circuit elements configuring the amplifier 62, the signal processing portion 63, and the information processing portion 64, so that each of the amplifier 62, the signal processing portion 63, and the information processing portion 64 is driven in a power saving state.

Additionally, at the time of switching from the normal power mode to the power saving mode, the receiving device 6 is brought into the power saving state by the controller 7 in the order of the information processing portion 64, the signal processing portion 63, and the amplifier 62. By contrast, at the time of switching from the power saving mode to the normal power mode, the receiving device 6 is brought into the normal power state by the controller 7 in the order of the amplifier 62, the signal processing portion 63, and the information processing portion 64.

The identification information output to the controller 7 is correlated with reception time and is accumulated as log data in a memory. The log data accumulated in the memory is correlated with identification information of the working machine 1 on a predetermined unit time (e.g. one day) basis and is transmitted to a server (not shown) via a communication network. The server received the log data accumulates the log data in a memory of the server itself. The server receives such log data from a plurality of working machines to accumulate the log data in the memory. In this manner, a manager can manage which attachment 43 is attached or has been previously attached in each working machine 1.

The controller 7 also recognizes the currently attached attachment 43 based on identification information transmitted from the transmission device 5, and executes control of the working machine 1 according to the recognized attachment 43.

The posture sensor 80, which is configured with, for example, a potentiometer, an angular velocity sensor, or an acceleration sensor, detects each of an angle of the boom 41 to the upper slewing body 3, an angle of the arm 42 to the boom 41, and an angle of the attachment 43 to the arm 42 at, for example, a fixed sampling interval, and outputs the detected angle to the controller 7 as posture information of the working device 4.

The controller 7 is configured with a computer including a processor such as CPU, and a memory, for example. In the present embodiment, the controller 7 includes a determination portion 71.

The receiving device 6 and the controller 7 are connected via wires. The posture sensor 80 and the controller 7 are also connected via wires. This is because the controller 7 needs constant monitoring of posture information detected by the posture sensor 80, the posture information indicating a physical quantity for use in interference prevention control for preventing the working device 4 from interfering with the upper slewing body 3 and the lower travelling body 2, and the like. By contrast, the identification information transmitted from the transmission device 5 is information for use in managing which attachment 43 is mounted on the working machine 1 and is not required to be such severely real-time information as required of the posture information. Therefore, in the present embodiment, the identification information is transmitted wirelessly.

The determination portion 71 is provided in the controller 7 which is on another chip separate from the receiving device 6 and determines based on posture information detected by the posture sensor 80 whether the working device 4 is at a receivable posture which allows the receiving device 6 to receive a radio signal transmitted from the transmission device 5 or the working device 4 is at an unreceivable posture which does not allow the receiving device 6 to receive a radio signal transmitted from the transmission device 5. Then, when determining that the working device 4 is at the unreceivable posture, the determination portion 71 sets the receiving device 6 in the power saving mode. On the other hand, when determining that the working device 4 takes the receivable posture with the receiving device 6 being set in the power saving mode, the determination portion 71 returns the receiving device 6 to the normal power mode. At the time of turn-on of an ignition key, the receiving device 6 is being set in the normal power mode.

Here, the angle of the boom 41 to the upper slewing body 3, the angle of the arm 42 to the boom 41, and the angle of the attachment 43 to the arm 42 are represented as θ1 to θ3, respectively. In the memory of the controller 7, a map is stored in which a plurality of combinations of the angles θ1 to θ3 and information indicating whether the working device 4 is at the receivable posture with respect to, for example, each of the combinations of the angles θ1 to θ3 are registered. The map is prepared in advance by conducting such simulation as shown below. Specifically, in the simulation, first, a location of the transmission device 5 is calculated for each combination of the angles θ1 to θ3, and the communicable area D1 shown in FIG. 1 is set at the calculated location. Next, in a case where the receiving device 6 is located in the communicable area D1, when components (e.g. the boom 41 and the arm 42) of the working device 4 are not present in the communicable area D1 as a shielding object which shields a radio signal from the transmission device 5, determination is made that the working device 4 is at the receivable posture in the corresponding combination of the angles θ1 to θ3, and the determination result is written into the map. By contrast, in a case where the receiving device 6 is not located in the communicable area D1, determination is made that the working device 4 is at the unreceivable posture in the corresponding combination of the angles θ1 to θ3, and the determination result is written into the map. Even in a case where the receiving device 6 is located in the communicable area D1, when the shielding object is present in the communicable area D1, determination is made that the working device 4 is at the unreceivable posture, and the determination result is written into the map.

Next, operation of the working machine 1 according to the first embodiment will be described. When the ignition key of the working machine 1 is turned on, the determination portion 71 determines whether posture of the working device 4 corresponding to the posture information (the angles θ1 to θ3) detected by the posture sensor 80 is the receivable posture by referring to the map stored in the memory. The determination is made every time the posture sensor 80 acquires posture information at a predetermined sampling cycle while the ignition key of the working machine 1 is on.

Then, while the working device 4 is at the receivable posture, the receiving device 6 is set in the normal power mode, and when the posture of the working device 4 is changed to the unreceivable posture, the receiving device 6 is set in the power saving mode.

Then, with the receiving device 6 being set in the power saving mode, when the posture of the working device 4 is changed to the receivable posture, the receiving device 6 is returned to the normal power mode.

Thus, in the present embodiment, in a case where a radio signal transmitted from the transmission device 5 is shielded by the boom 41 and the arm 42, and the working device 4 is at a posture that does not allow the receiving device 6 to receive the radio signal, useless power consumption of the receiving device 6 can be prevented because the receiving device 6 is set in the power saving mode.

Additionally, since determination of the receivable posture and the unreceivable posture is made by the determination portion 71 of the controller 7 provided separately from the receiving device 6, the determination can be made even after the receiving device 6 is set in the power saving mode.

Second Embodiment

It is a common practice in the working device 4 to take only the attachment 43 attached to a front end of the working device 4 as a replacement target. It is however supposed that the arm 42 and the boom 41 other than the attachment 43 are considered as replacement targets in the future, and in this case, it is desirable that transmission devices are disposed also in the arm 42 and the boom 41 and managed. Under these circumstances, transmission devices for transmitting identification information are disposed also in the arm. 42 and the boom 41 in a second embodiment. In the second embodiment, the same components as those of the first embodiment are given the same reference codes to omit description thereof.

Figure 3:
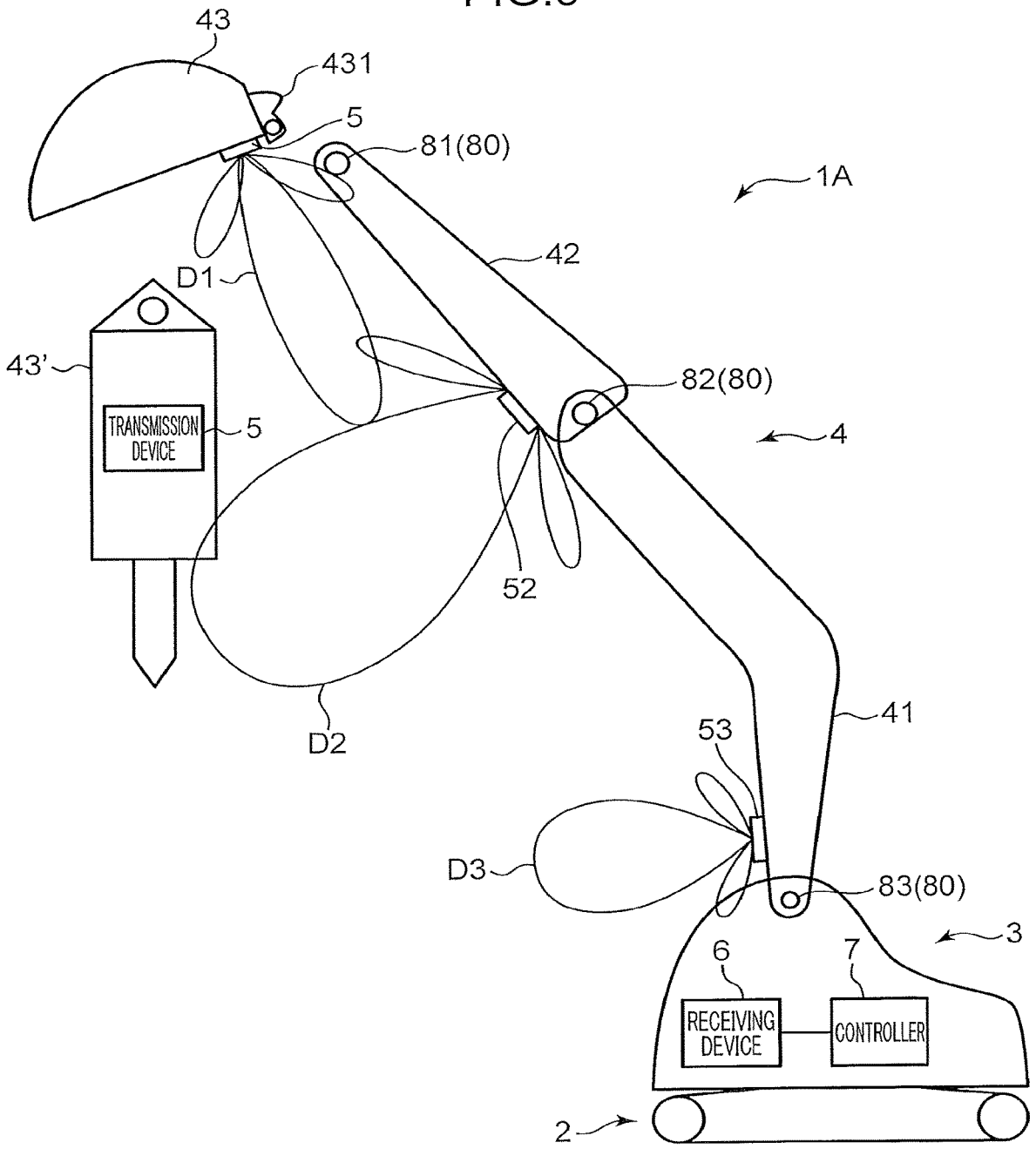
FIG. 3 is a configuration view of a working machine according to a second embodiment of the present invention.

FIG. 3 is a configuration view of a working machine 1A according to the second embodiment of the present invention. As shown in FIG. 3, the working machine 1A includes a transmission device 52 and a transmission device 53 disposed in the boom 41 and the arm 42, respectively, other than the attachment 43.

In the second embodiment, not only the attachment 43 but also the boom 41 and the arm 42 are replaceably configured, in which the attachment 43, the boom 41, and the arm 42 each correspond to one example of the replacement portion.

Although in the example of FIG. 3, the transmission device 52 is provided on a rear end side (a side of the boom 41) of the arm 42, this is merely an example and there is no particular limitation on the arrangement position. The transmission device 52 may be provided on a front end side (a side of the attachment 43) of the arm 42, or provided in a center of the arm 42 in a longitudinal direction.

Although in the example of FIG. 3, the transmission device 53 is provided on a rear end side (a side of the upper slewing body 3) of the boom 41, this is merely an example and there is no particular limitation on the arrangement position. The transmission device 53 may be provided on a front end side (a side of the arm 42) of the boom 41, or provided in a center of the boom 41 in the longitudinal direction.

Although in the example of FIG. 3, the transmission device 52 and the transmission device 53 are provided on lower surfaces of the boom 41 and the arm 42, the surfaces being opposed to the ground, this is merely an example and the transmission device 52 and the transmission device 53 may be provided on side surfaces or upper surfaces of the boom 41 and the arm 42.

Similarly to the transmission device 5, the transmission device 52 and the transmission device 53 are respectively provided with communicable areas D2 and D3 including a main lobe and a side lobe.

Figure 4:
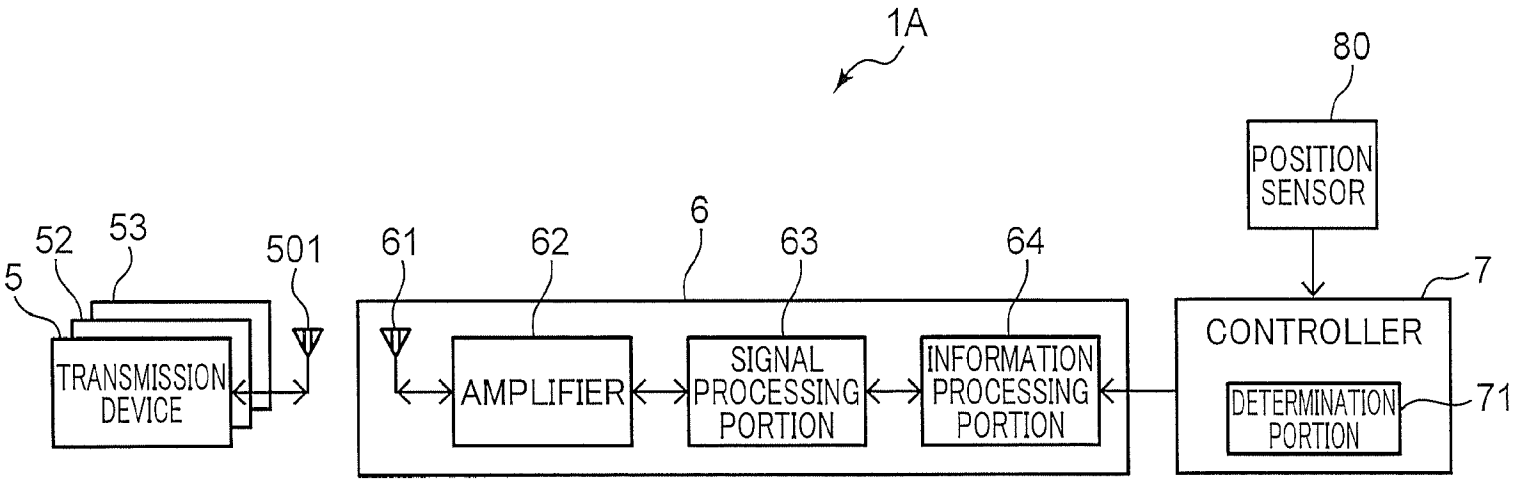
FIG. 4 is a block diagram of components in charge of communication in the working machine shown in FIG. 3.

FIG. 4 is a block diagram of components in charge of communication in the working machine 1A shown in FIG. 3. In FIG. 4, a difference from FIG. 2 is that in addition to the transmission device 5, the transmission device 52 and the transmission device 53 are further provided. Since the transmission device 52 and the transmission device 53 have the same configuration as that of the transmission device 5 and description thereof will be therefore omitted.

The determination portion 71 deter wines that the working device 4 is at the receivable posture in a case where the working device 4 is at a posture which allows the receiving device 6 to receive a radio signal transmitted from at least one of the transmission devices 5, 52, and 53. By contrast, the determination portion 71 determines that the working device 4 is at the unreceivable posture in a case where the working device 4 is not at a posture which allows the receiving device 6 to receive a radio signal transmitted from at least one of the transmission devices 5, 52, and 53.

Here, in the memory of the controller 7, a map is stored in which information is registered, the information indicating whether for each of the transmission devices 5, 52, and 53, the working device 4 is at the receivable posture with respect to each of the combinations of the angles θ1 to θ3.

Thus, the determination portion 71 determines whether for each of the transmission devices 5, 52, and 53, the working device 4 is at the receivable posture with respect to the combinations of the angles θ1 to θ3 detected by the posture sensor 80. Then, in a case where there is registered, in the map, information indicating that the working device 4 is at the receivable posture for at least one of the transmission devices 5, 52, and 53, the determination portion 71 can determine that the working device 4 is at the receivable posture.

In the second embodiment, the determination portion 71 may determine that the working device 4 is at the receivable posture on condition that the working device 4 is at the receivable posture for all the transmission devices 5, 52, and 53, or may determine that the working device 4 is at the receivable posture on condition that the working device 4 is at the receivable posture for any two of the transmission devices 5, 52, and 53.

Calculation of the map used in the second embodiment is realized by applying the simulation described in the first embodiment to each of the transmission devices 52 and 53.

In this manner, in the second embodiment, the working device 4 includes a plurality of replacement portions, and even in a case where each of the plurality of replacement portions includes a transmission device, the determination portion 71 can determine whether the working device is at the receivable posture.

Third Embodiment

As described in the second embodiment, in a case where such a configuration is adopted in which the working device 4 includes a plurality of replacement portions and a transmission device is disposed in each replacement portion, some managers of a working machine may consider that it is sufficient to manage an operating condition of any one of the replacement portions. In this case, it is useless to determine whether the working device 4 is at the receivable posture for a transmission device disposed in a replacement portion whose management is not demanded by a manager. A third embodiment aims at preventing the useless determination. In the third embodiment, the same components as those of the first and second embodiments are given the same reference codes to omit description thereof.

Figure 5:
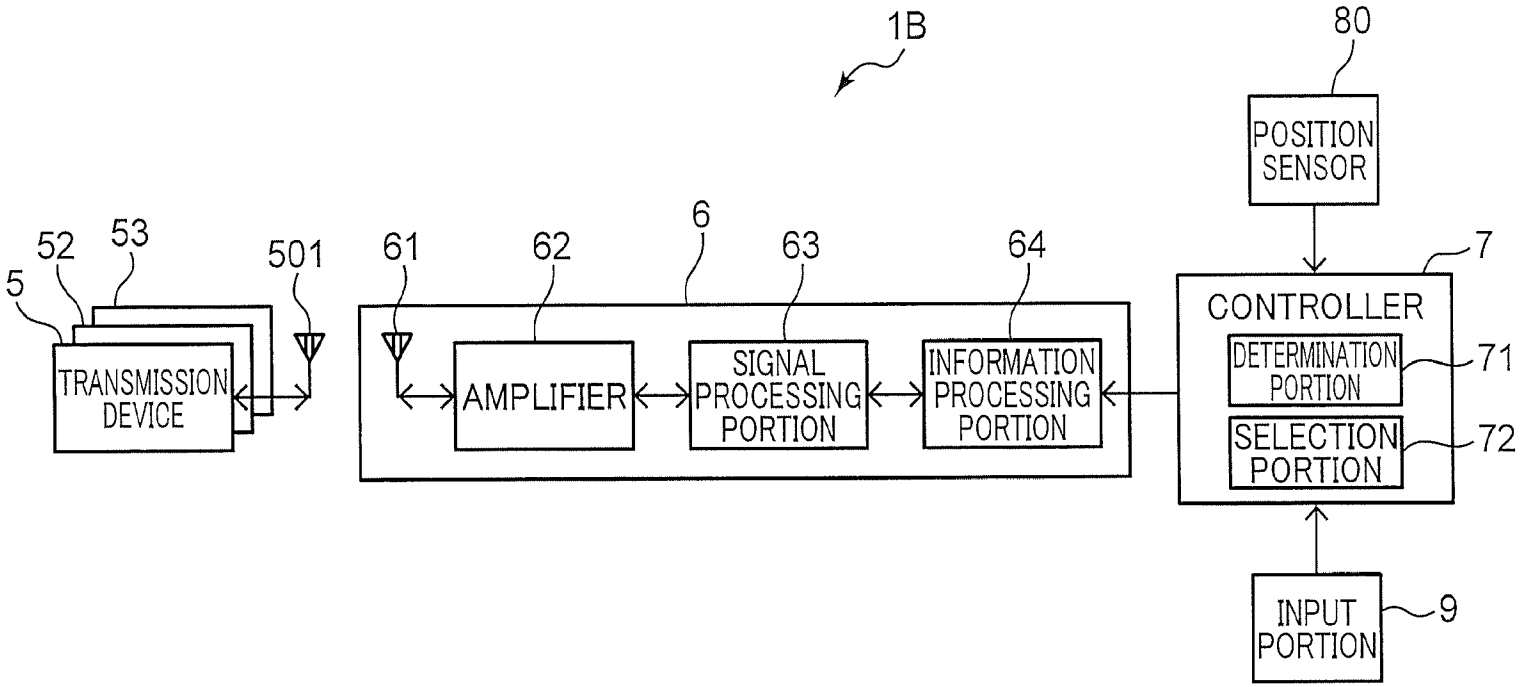
FIG. 5 is a block diagram of components in charge of communication of a working machine according to a third embodiment of the present invention.

FIG. 5 is a block diagram of components in charge of communication of a working machine 1B according to the third embodiment of the present invention.

In FIG. 5, a difference from FIG. 4 is that an input portion 9 is further provided, and in the controller 7, a selection portion 72 is further provided in addition to the determination portion 71.

The input portion 9 is configured with, for example, an input switch provided in a cabin of the upper slewing body 3, and receives an instruction from an operator for selecting any one of the boom 41, the arm 42, and the attachment 43 as a recognition target.

According to an instruction from an operator which is received by the input portion 9, the selection portion 72 selects any one of the boom 41, the arm 42, and the attachment 43 as a recognition target.

The determination portion 71 sets, as a target transmission device 5*x*, one transmission device disposed in one recognition target selected by the selection portion 72 among the transmission devices 5, 52, and 53. Here, information is stored in the memory in advance, the information indicating which transmission device is disposed in each of the boom 41, the arm 42, and the attachment 43, and the determination portion 71 may specify a transmission device disposed in the selected recognition target by referring to the information.

Assuming, for example, that the arm 42 is selected as a recognition target, the transmission device 52 is set as the target transmission device 5*x*, and assuming that the boom 41 is selected as a recognition target, the transmission device 53 is set as the target transmission device 5*x*.

Then, when the working device 4 is not at a posture which allows the receiving device 6 to receive a radio signal of the target transmission device 5*x*, the determination portion 71 determines that the working device 4 is at the receivable posture, and sets the receiving device 6 in the normal power mode. By contrast, when the working device 4 is at a posture which does not allow the receiving device 6 to receive a radio signal of the target transmission device 5*x*, the determination portion 71 determines that the working device 4 is at the unreceivable posture, and sets the receiving device 6 in the power saving mode.

Here, in the memory of the controller 7 the map described in the second embodiment, that is, the map in which information indicating whether for each of the transmission devices 5, 52, and 53, the working device 4 is at the receivable posture with respect to each of the combinations of the angles θ1 to θ3 is registered.

Thus, the determination portion 71 may determine whether the working device 4 is at the receivable posture by referring, in the map, to the information indicating whether the working device is at the receivable posture for the transmission device selected as the target transmission device 5*x*.

In this manner, according to the third embodiment, even in a case where a plurality of transmission devices are disposed in the working device 4, determination can be made whether the working device 4 is at the receivable posture only for a transmission device whose management is required.

Fourth Embodiment

A fourth embodiment intends to determine that the working device 4 is at the unreceivable posture in a case where in the first to third embodiments, the attachment 43 is located below the ground contact surface of the lower travelling body 2. In the present embodiment, the same components as those of the first to third embodiments are given the same reference codes to omit description thereof.

In the fourth embodiment, there is registered, in the map stored by the memory of the controller 7, information which brings the working device 4 into the unreceivable posture with respect to a combination of the angles θ1 to θ3 in a case where the attachment 43 is located below the ground contact surface. In other words, in addition to the simulation result described in the first embodiment, there is registered, in the map, information which brings about an unreceivable state with respect to a combination of the angles θ1 to θ3 calculated by simulation, the combination of the angles θ1 to θ3 being in a case where the attachment 43 is located below the ground contact surface.

Accordingly, in a case where posture information detected by the posture sensor 80 indicates the combination of the angles θ1 to θ3 at which angle, the attachment 43 is located below the ground contact surface, when the determination portion 71 refers to the map to make determination about the receivable posture, the determination portion 71 eventually determines that the working device 4 is in the unreceivable state.

For example, in a case where the lower travelling body 2 works on a shoulder of cliffy land while being grounded thereon, when the attachment 43 is brought to a location below the ground contact surface of the lower travelling body 2, a radio signal of the transmission device 5 is shielded by a slope of the cliffy land, so that there is a possibility that the receiving device 6 cannot receive the radio signal of the transmission device 5. Since in the fourth embodiment, the receiving device 6 is set in the power saving mode in such a case, useless power consumption of the receiving device 6 can be suppressed.

MODIFICATION

The present invention can adopt the following modifications.

(1) While the third embodiment has been described assuming that one target transmission device 5*x* is provided, the present invention is not limited thereto and a plurality of target transmission devices 5*x* may be provided.

In this case, for each of the plurality of target transmission devices 5*x*, the determination portion 71 refers to the map used in the second embodiment to determine whether the working device 4 is at the receivable posture based on the posture information detected by the posture sensor 80. Then, in a case where it is registered in the map that the working device 4 is at the receivable posture for at least one of the plurality of target transmission devices 5*x*, the determination portion 71 can determine that the working device 4 is at the receivable posture.

(2) While in the fourth embodiment, when the attachment 43 is located below the ground contact surface, determination is made that the working device 4 is not at the receivable posture, the present invention is not limited thereto. In a case, for example, where the replacement portion in which the plurality of transmission devices are disposed as shown in the second embodiment, or the recognition target in which the target transmission device 5*x* as shown in the third embodiment is disposed, is located below the ground contact surface, the determination portion 71 may determine that the working device 4 is not at the receivable posture and set the receiving device 6 in the power saving mode.

(3) While the first to fourth embodiments have been described assuming that the working device 4 is configured with three components of the attachment 43, the boom 41, and the arm 42, the present invention is not limited thereto, and the working device may be configured with four or more components, or one or two components. In this case, all the components of the working device 4 may be replacement portions or a part of the components may be replacement portions. In a case where a plurality of replacement portions are provided, a transmission device may be disposed in every replacement portion or the transmission device may be disposed in a part of the replacement portions. Also in this case, the manners described in the first to fourth embodiments are applicable.

(4) While the first to fourth embodiments have been described assuming that one receiving device 6 is provided, the present invention is not limited thereto, and a plurality of receiving devices 6 may be provided corresponding to a plurality of transmission devices disposed in a plurality of replacement portions.

(5) The receiving device 6 and the controller 7 separately configured in FIG. 1 and FIG. 2 may be integral with each other. In this case, the determination portion 71 of the controller 7 may be driven in the normal power mode even when the receiving device 6 enters the power saving mode.

SUMMARY OF THE EMBODIMENTS

Technical features of the present embodiments are summarized as follows.

A working machine according to an aspect of the present invention includes a main body portion; a working device mounted on the main body portion so as to have a changeable posture and including one or a plurality of replaceable replacement portions; a posture sensor which detects a posture of the working device; one or a plurality of transmission devices disposed in the replacement portions for transmitting a radio signal including identification information of the replacement portions; a receiving device disposed in the main body portion for receiving a radio signal transmitted from the transmission devices; and a determination portion which determines whether the working device is at a receivable posture which allows the receiving device to receive the radio signal or the working device is at an unreceivable posture which does not allow the receiving device to receive the radio signal based on posture information detected by the posture sensor, in which when determining that the working device is at the unreceivable posture, the determination portion sets the receiving device in a power saving mode in which the radio signal is unreceivable, and when determining that the working device takes the receivable posture with the receiving device being set in the power saving mode, and returns the receiving device to a normal power mode in which the radio signal is receivable.

According to the present aspect, in a case where a radio signal transmitted from the transmission device disposed in the replacement portion is shielded by the working device, and the working device is at a posture that does not allow the receiving device to receive the radio signal, useless power consumption of the receiving device can be prevented because the receiving device is set in the power saving mode.

Then, after the receiving device is set in the power saving mode, when the posture of the working device changes to the receivable posture, the receiving device is returned from the power saving mode to the normal power mode, resulting in avoiding a situation where communication between the transmission device and the receiving device will not be resumed forever.

In the above aspect, it is preferable that the replacement portion includes a plurality of replacement portions, the transmission device is disposed in at least one of the plurality of replacement portions and is configured with at least one transmission device which transmits a radio signal including identification information of the corresponding replacement portion, and when the working device is at a posture which allows the receiving device to receive a radio signal of the at least one transmission device, the determination portion determines that the working device is at the receivable posture, and when the working device is at a posture which does not allow the receiving device to receive a radio signal of the at least one transmission device, determines that the working device is at the unreceivable posture.

According to the present aspect, even in a case where the working device includes a plurality of replacement portions and at least one of the plurality of replacement portions includes the transmission device, the determination portion can determine whether the working device is at the receivable posture.

In the above aspect, it is preferable that the at least one transmission device is configured with a plurality of transmission devices disposed in the plurality of replacement portions, respectively, and the working machine further includes a selection portion which selects at least one of the plurality of replacement portions as a recognition target of identification information, in which the determination portion sets, as a target transmission device, at least one transmission device disposed in a recognition target selected by the selection portion among the plurality of transmission devices, and when the working device is at a posture which allows the receiving device to receive the radio signal of the target transmission device, determines that the working device is at the receivable posture, and when the working device is at a posture which does not allow the receiving device to receive the radio signal of the target transmission device, and determines that the working device is at the unreceivable posture.

In a case where the working machine is configured with a plurality of replacement portions, the transmission device is disposed in each replacement portion, so that a radio signal including identification information is transmitted from a plurality of transmission devices.

However, some managers of the working machine do not always demand management of an operating condition of every replacement portion and consider that it is sufficient to manage an operating condition of at least one replacement portion among all the replacement portions. In this case, it is unnecessary to determine whether the receiving device is allowed to receive a radio signal of a transmission device disposed in a replacement portion whose management is not demanded by a manager.

In the present aspect, at least one of the plurality of replacement portions is selected as a recognition target of identification information and at least one transmission device disposed in the selected at least one recognition target is set as a target transmission device. Then, determination is made only for the target transmission device whether the working device is at the receivable posture. Therefore, even in a case where a plurality of transmission devices are disposed in the working device, determination can be made whether the working device is at the receivable posture only for a required transmission device.

In the above aspect, it is preferable that when determining that the replacement portion is located below a ground contact surface of the main body portion based on the posture information, the determination portion determines that the working device is at the unreceivable posture.

For example, in a case where the main body portion works on a shoulder of cliffy land while being grounded thereon, when the replacement portion is brought to a location below the ground contact surface of the main body portion, a radio signal of the transmission device is shielded by a slope of the cliffy land, so that there is a possibility that the transmission device cannot receive the radio signal of the receiving device. Under these circumstances, the present aspect enables the receiving device to be set in the power saving mode in such a case, thereby suppressing useless power consumption of the receiving device.

In the above aspect, a memory may be further provided which stores a map in which there are correlated with each other in advance a plurality of measurement values detected by the posture sensor and information, with respect to each of the plurality of measurement values, about whether the working device is at the receivable posture, in which the determination portion determines whether the working device is at the receivable posture using the map.

According to the present aspect, determination can be accurately and quickly made whether the working device is at the receivable posture.

This application is based on Japanese Patent application No. 2017-207894 filed in Japan Patent Office on Oct. 27, 2017, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A working machine comprising:

a main body portion;

a working device mounted on the main body portion so as to have a changeable posture, the working device including one or a plurality of replaceable replacement portions;

a posture sensor which detects a posture of the working device;

one or a plurality of transmission devices disposed in the replacement portions for transmitting a radio signal including identification information of the replacement portions;

a receiving device disposed in the main body portion for receiving a radio signal transmitted from the transmission devices; and a determination portion which determines whether the working device is at a receivable posture which allows the receiving device to receive the radio signal or the working device is at an unreceivable posture which does not allow the receiving device to receive the radio signal based on posture information detected by the posture sensor, wherein when determining that the working device is at the unreceivable posture, the determination portion sets the receiving device in a power saving mode in which the radio signal is unreceivable, and when determining that the working device takes the receivable posture with the receiving device being set in the power saving mode, and returns the receiving device to a normal power mode in which the radio signal is receivable.

2. The working machine according to claim 1, wherein the replacement portion includes a plurality of replacement portions, the transmission device is disposed in at least one of the plurality of replacement portions and is configured with at least one transmission device which transmits a radio signal including identification information of the corresponding replacement portion, and when the working device is at a posture which allows the receiving device to receive a radio signal of the at least one transmission device, the determination portion determines that the working device is at the receivable posture, and when the working device is at a posture which does not allow the receiving device to receive a radio signal of the at least one transmission device, and determines that the working device is at the unreceivable posture.

3. The working machine according to claim 2, wherein the at least one transmission device is configured with a plurality of transmission devices disposed in the plurality of replacement portions, respectively, the working machine further comprising:

a selection portion which selects at least one of the plurality of replacement portions as a recognition target of identification information, wherein the determination portion sets, as a target transmission device, at least one transmission device disposed in a recognition target selected by the selection portion among the plurality of transmission devices, and when the working device is at a posture which allows the receiving device to receive the radio signal of the target transmission device, determines that the working device is at the receivable posture, and when the working device is at a posture which does not allow the receiving device to receive the radio signal of the target transmission device, and determines that the working device is at the unreceivable posture.

4. The working machine according to claim 1, wherein when determining that the replacement portion is located below a ground contact surface of the main body portion based on the posture information, the determination portion determines that the working device is at the unreceivable posture.

5. The working machine according to claim 1, further comprising a memory which stores a map in which there are correlated with each other in advance a plurality of measurement values detected by the posture sensor and information, with respect to each of the plurality of measurement values, about whether the working device is at the receivable posture, wherein the determination portion determines whether the working device is at the receivable posture using the map.

* * * * *